United States Patent [19]

Shibata et al.

[11] Patent Number: 4,778,694

[45] Date of Patent: Oct. 18, 1988

[54] METHOD FOR APPLICATION WITH USE OF WEB VIBRATION ABSORBER

[75] Inventors: Norio Shibata; Tsunehiko Sato; Hideo Takeda; Naoyoshi Chino, all of Kanagawa, Japan

[73] Assignee: Fuji Photo Film Co., Ltd., Kanagawa, Japan

[21] Appl. No.: 109,562

[22] Filed: Oct. 19, 1987

Related U.S. Application Data

[62] Division of Ser. No. 39,420, Apr. 17, 1987.

[30] Foreign Application Priority Data

Apr. 17, 1986 [JP] Japan ..... 61-87182

[51] Int. Cl.[4] ..... B05D 1/00

[52] U.S. Cl. ..... 427/209; 427/378

[58] Field of Search ..... 427/209, 378, 348

[56] References Cited

U.S. PATENT DOCUMENTS

| | | | |
|---|---|---|---|
| Re. 22,605 | 2/1945 | Goff et al. | 427/348 X |
| 2,309,090 | 1/1943 | Bauer et al. | 427/209 X |
| 3,231,415 | 1/1966 | Grenley et al. | 427/348 |
| 4,554,177 | 11/1985 | Chikamasa et al. | 427/378 X |

*Primary Examiner*—Bernard D. Pianalto

*Attorney, Agent, or Firm*—Sughrue, Mion, Zinn, Macpeak & Seas

[57] ABSTRACT

A vibration damper for use with an apparatus for applying liquid to both sides of a running web and then drying the web with an air drier. Vibrations induced by the air drier are damped by uniformly blowing air on both sides of the running web between the drier and the liquid application heads. Preferably, the gas ejection surfaces are stepped or tapered so allow larger vibrations near the drier but to reduce the allowed vibration nearer the liquid application heads.

1 Claim, 3 Drawing Sheets

METHOD FOR APPLICATION WITH USE OF WEB VIBRATION ABSORBER

This is a division of application Ser. No. 039,420, filed Apr. 17, 1987.

BACKGROUND OF THE INVENTION

1. Field of the Invention

The present invention relates to the application of a liquid to a web (which is a long flexible belt-like uncoated or coated material such as a plastic film, paper and a metal sheet) with the use of a web vibration absorber so as to assure the flatness of the web in manufacturing the web.

2. Background of the Invention

In a conventional method of absorbing the vibration of an uncoated or coated web such as a plastic film, paper and a metal sheet in manufacturing the web, a roller, a drum, a suction table or the like has been used for the absorption of the vibration.

However, when a liquid is applied to both sides of a web and a drier is used to dry the applied liquid without coming into contact with either side of the web, none of the above described mechanical contact absorbers can be used to absorb the vibration of the web caused by an ejected gas in the drier and a web mover in order to prevent the vibration from adversely affecting the application of the liquid. Alternatively, a method can be used, such as that disclosed in the Japanese Patent Application (OPI) No. 109162/83, where (the term "OPI" as used herein means an "unexamined published application") in which the liquid is applied while pushing an extrusive application head which is little adversely affected by the vibration is adopted. However, even in this case, the vibration causes the thickness of the film of the applied liquid to be made non-uniform in the direction of the movement of the web. For these reasons, it has been difficult to put into practical use a process of simultaneously performing both the application of the liquid to both the sides of the web and the drying of the applied liquid thereon.

SUMMARY OF THE INVENTION

Accordingly, it is an object of the present invention to provide a method and a device for applying liquid to web with the use of a web vibration absorber which eliminates the vibration of a web to prevent the fluctuation in the thickness of the film of an applied liquid to thereby make the thickness of the film uniform. The invention is useful in the case that the vibration of the web cannot be damped and eliminated by placing a roller, a drum or the like in contact with the web.

It is another object of the present invention to provide a method and a device for applying liquid to a web with the use of a web vibration absorber which functions not only to eliminate the vibration of a web but also to prevent the web from being wrinkled in its longitudinal direction.

Each of the web vibration absorbers eliminates the vibration of the web caused by a unit which floats the web by a jetted gas. In the web vibration absorber, two gas ejection cylinders (hereinafter called "chambers") containing distributors are provided to face each other across the web to form thin gas films between the surface of the web and the gas ejection surfaces of the chambers.

In the method and device for applying a liquid to a web with the use of the web vibration absorber, the liquid is applied to both the sides of the web and then dried by a drier not located in contact with the web. The web vibration absorber comprises a blower and gas ejection chambers facing each other across the web and is placed between the drier and the one of perhaps plurally applied liquid feeders which is located nearest the drier. As a result, the vibration of the web caused by the drier is eliminated by the web vibration absorber. A solid blade is provided in contact with the surface of the web between the web vibration absorber and the applied liquid feeder nearest the drier.

When the amplitude of the vibration of the web is relatively large, it is preferable that each of the web vibration absorbers has a plurality of pairs of gas ejection chambers and that the clearance between the surface of the web and each gas ejection surface of the pair of the gas ejection chambers located upstream with respect to the direction of the movement of the web is smaller than that between the surface of the web and each gas ejection surface of the other pair of the gas ejection chambers located downstream with respect to this direction.

When the amplitude of the vibration of the web is relatively small, it is preferable that each of the web vibration absorbers has a single pair of gas ejection chambers, and that the clearance between the surface of the web and the upstream portion of each gas ejection surface of the chambers is smaller than that between the surface of the web and downstream portion of the gas ejection surface.

When the amplitude of the vibration of the web is very small, it is preferable that each of the web vibration absorbers has a single pair of gas ejection chambers, and the clearance between the surface of the web and each gas ejection surface of the gas ejection chambers is minute and is constant in the direction of the movement of the web.

BRIEF DESCRIPTION OF THE DRAWINGS

FIG. 3(*b*) shows a sectional view of a web vibration absorber similar to that of FIG. 3(*a*) but having curved gas ejection surfaces.

DETAILED DESCRIPTION OF PREFERRED EMBODIMENTS

Embodiments of the present invention are hereafter described with reference to the drawings attached hereto.

Figure 1:
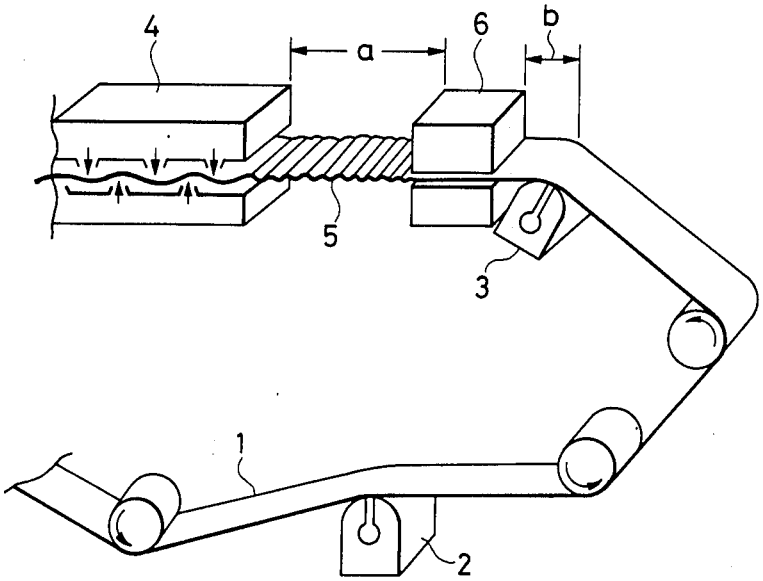
FIG. 1 shows a perspective view of the first embodiment of the present invention, in which a web vibration absorber provided in accordance with the present invention is used for a double-sided liquid application device to manufacture a magnetic recording material.

FIG. 1 shows a perspective view of the first embodiment of the present invention, in which a web vibration absorber provided in accordance with the present invention is used for a double-side application device to manufacture a magnetic recording material. A magnetic liquid is applied to both the side of a web 1 through applied liquid feeders 2 and 3 in a method (such as that disclosed in the Japanese Patent Application (OPI) No. 109162/83) in which extrusion application heads are pushed on the web 1. The web 1 is continuously run past the liquid feeders 2 and 3 by a series of rollers. Typically, the motive power is provided by the motor attached to the take-up reel onto which the web 1 is wound. The applied magnetic liquid is then dried by a double-sided noncontact drier 4. At that time, the web 1 experiences vibrations 5 due to the flow of gas ejected from the drier 4. Unless damped out, the vibrations 5 would affect the second applied liquid feeder 3 and would thereby cause the thickness of the film of the applied liquid to fluctuate in the running direction of the web 1. Such a fluctuation makes it difficult to manufacture the magnetic recording material of good quality. In actual practice, however, gas ejection chambers of a web vibration absorber 6 are placed near the second liquid feeder 3 to keep the feeder from being affected by the vibrations 5 of the web 1, to efficiently manufacture the magnetic recording material of good quality.

Figure 2:
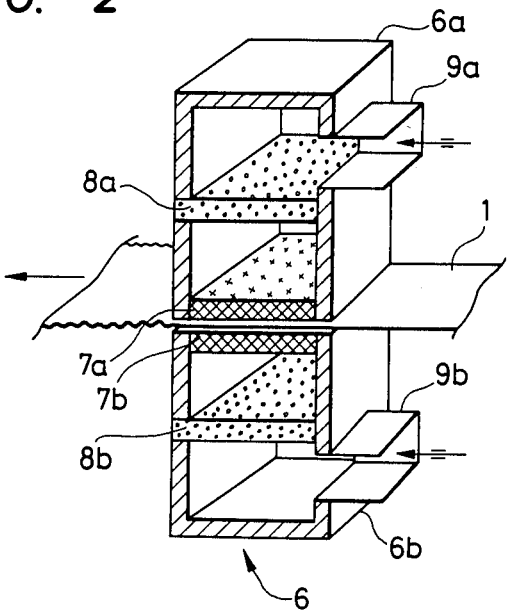
FIG. 2 shows a sectional view of the gas ejection chambers of a web vibration absorber provided in accordance with the present invention.

FIG. 2 shows a sectional view of a pair of gas ejection chambers 6*a* and 6*b* of the web vibration absorber 6 provided in accordance with the present invention. Gas ejection surfaces 7*a* and 7*b* of the chambers 6*a* and 6*b* face each other across a running web 1. The length of each of the gas ejection surfaces 7*a* and 7*b* extends along the total width of the web 1. The width of each of the surfaces 7*a* and 7*b* is relatively small. Since the clearance between the surface of the web 1 and the gas ejection surfaces 7*a* and 7*b* becomes very small depending on the amplitude of the vibration of the web 1, the gas ejection surfaces are made of a porous material or provided with very small holes of circular or slender cross section to provide gas ejection holes distributed uniformly across the entire gas ejection surfaces 7*a* and 7*b*. Such widely distributed gas ejection holes support the web 1 in a stable state without coming into contact with the gas ejection surfaces and also absorb the vibration. In order to uniformly eject a gas from the gas ejection surfaces 7*a* and 7*b* to the web 1, distributors (distribution plates) 8*a* and 8*b* are provided in the gas ejection chambers 6*a* and 6*b*. Regulated gas from a blower, not shown in the drawings, enters into the chambers 6*a* and 6*b* through gas feed ports 9*a* and 9*b* and then is distributed to the gas ejection surfaces 7*a* and 7*b* under pressure made uniform by the distributors 8*a* and 8*b*. The distributors 8*a* and 8*b* are made of a packed material, a filter or a porous material which has some resistance to the flow of the gas.

Figure 3A:
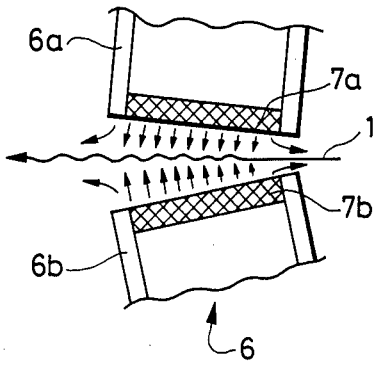
FIG. 3(*a*) shows a sectional view of a web vibration absorber which is provided in accordance with the present invention and in which a single pair of gas ejection chambers having flat gas ejection surfaces are disposed so that the clearance between the surface of a web and the upstream portion (with respect to the direction of the movement of the web) of each gas ejection surface of the chambers is smaller than that between the surface of the web and the downstream portion of the gas ejection surface.
Figure 3B:
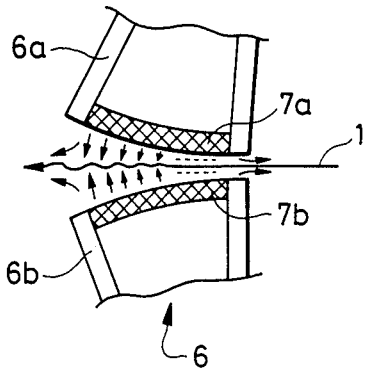

Each of FIGS. 3(*a*) and 3(*b*) shows a sectional view of the gas ejection surfaces 7*a* and 7*b* of a single pair of gas ejection chambers 6*a* and 6*b* of a web vibration absorber 6 provided in accordance with the present invention. The gas ejection chambers 6*a* and 6*b* are disposed so that the clearance between the surface of the web 1 an the upstream side (with respect to the direction of the movement of the web 1) of each gas ejection surface 7*a* or 7*b* of the chambers 6*a* and 6*b* is smaller than that between the surface of the web 1 and the downstream side (as to the web running direction) of the gas ejection surface 7*a* or 7*b*.

The gas ejection surfaces of the gas ejection chambers 6*a* and 6*b* shown in FIG. 3(*a*) are flat, while those of the gas ejection chambers 6*a* and 6*b* shown in FIG. 3(*b*) are curved.

Each of the web vibration absorbers 6 shown in FIGS. 3(*a*) and 3(*b*) is used when the amplitude of the vibrations 5 of the web 1 is slightly larger than that for the web vibration absorber 6 shown in FIG. 2.

Figure 4:
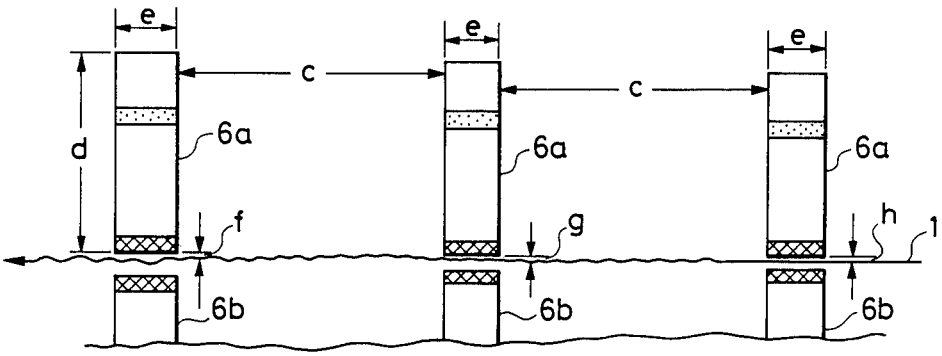
FIG. 4 shows a sectional view of a web vibration absorber which is provided in accordance with the present invention and in which a plurality of pairs of gas ejection chambers are disposed so that the clearance between the surface of a web and each gas ejection surface of the pair of the gas ejection chambers located upstream as to the direction of the movement of the web is smaller than that between the surface of the web and each gas ejection surface of the other pair of the gas ejection chambers located downstream as to the direction.

FIG. 4 shows a sectional view of a web vibration absorber provided in accordance with the present invention so as to be used when the amplitude of the vibration of a web is relatively large. The web vibration absorber 6 has a plurality of pairs of gas ejection chambers 6*a* and 6*b* disposed along the length of the running web 1. The upper chambers 6*a* are spaced apart from the corresponding lower chambers 6*b* so that the clearance between the surface of the web 1 and each gas ejection surface 7*a* or 7*b* of the pair of the gas ejection chambers 6*a* and 6*b* located upstream as to the direction of the movement of the web is smaller than that between the surface of the web 1 and each gas ejection surface 7*a* or 7*b* of the other pairs of the gas ejection chambers 6*a* and 6*b* located downstream as to the web direction. The clearance h, g and f between the surface of the web 1 and the gas ejection surfaces 7*a* or 7*b* sequentially located downstream as to the direction of the movement of the web 1 are related to each other as $h<g<f$.

The blower for sending the regulated gas into each of the gas ejection chambers provided in accordance with the present invention includes a regulator which controls the temperature and humidity of the ejected gas and if necessary removes dust from the gas, to send the gas at a desired flow rate and a necessary level of static pressure.

The distributor 8*a* or 8*b* contained in each of the gas ejection chambers 6*a* or 6*b* provided in accordance with the present invention functions so that the distribution of the pressure of the gas from the gas ejection surface 7*a* or 7*b* of the chamber 6*a* or 6*b* is made uniform. The gas is thus uniformly ejected from the gas ejection surfaces 7*a* and 7*b* to form thin films of the gas. The balance of the web 1 is kept by the thin films of the uniformly ejected gas so as to damp the vibration of the web. If the amplitude of the vibration of the web is large, a plurality of pairs of gas ejection chambers are disposed to sequentially eliminate the vibration of the web starting with the larger amplitude of the vibration. The clearance between the surface of the web 1 and each gas ejection surface 7*a* or 7*b* is made smaller sequentially away from the vibration-causing unit (drier) so as to damp the vibration to a desired amplitude.

An example of practical operation of the first embodiment, in which the web vibration absorber 6 is used for the double-side application device to manufacture the magnetic recording material, is now described. A magnetic liquid having a composition shown in TABLE 1 was prepared. Extrusion application heads were pushed on a web at a first and a second applied liquid feeders under conditions (such as those described in the Japanese Patent application (OPI) No. 109162/83) shown in FIG. 1. The apparatus applied the magnetic liquid to both the sides of the web to manufacture a magnetic recording material.

TABLE 1

| Constituent | Weight ratio |
|---|---|
| $\gamma$-$Fe_2O_3$ powder (consisting of spicular grains of 0.5 μm in the average of major diameters and having a coercive force of 320 Oe) | 300 parts |
| Copolymer of vinyl chloride and vinyl acetate (copolymerization ratio of 87:13; polymerization degree of 400) | 30 parts |
| Electroconductive carbon | 20 parts |
| polyamide resin (amine value of 300) | 15 parts |
| Lecithin | 6 parts |
| Silicone oil (dimethylpolysiloxane) | 3 parts |
| Xylol | 300 parts |
| Methylisobutylketone | 300 parts |
| n-butanol | 100 parts |

The web was made of polyethyele terephthalate and had a thickness of 75 μm and a width of 300 mm. The speed of the movement of the web was 100 m/min. The tension of the web was set at either 2.5 kg or 5 kg for the total width thereof. The average volume of the wet film of the applied magnetic liquid was 25 cc/$m^2$.

Three pairs of gas ejection chambers were provided in the web vibration absorber, as shown in FIG. 4. The distance a between the drier 4 and the most downstream gas ejection chambers was 1,000 mm. The distance between the second applied liquid feeder 3 and the most upstream gas ejection chambers was 300 mm. The interval between the neighboring pairs of the gas ejection chambers was 100 mm. Each of the gas ejection chambers had a length of 300 mm, a width e of 20 mm and a height d of 70 mm and contained a distributor which was a packed material. The gas ejection surface of each of the gas ejection chambers was made of a porous material. The gas ejection surfaces of the gas ejection chambers faced both the sides of the web so that the clearance f, g and e between the surface of the web and the gas ejection surfaces sequentially located inversely to the direction of the movement of the web were 2.0 mm, 1.0 mm and 0.3 mm, respectively.

When the web vibration absorber was not provided, the amplitude of the vibration of the web at the entrance of the drier was 8.7 mm at the web tension of 2.5 kg for total width of the web and 5.8 mm at the web tension of 5 kg for the total width of the web.

When the web vibration absorber was provided, the vibration of the web was almost completely eliminated by the absorber. TABLE 2 shows the measured maximum values of the fluctuations in the thicknesses of the dried films of the magnetic liquid applied with and without the use of the web vibration absorber.

TABLE 2

| Web vibration absorber | Tension 2.5 kg/width | Tension 5.0 kg/width |
|---|---|---|
| Not Used | 1.0 μm | 0.7 μm |
| Used | 0.1 μm | 0.15 μm |

It is understood from TABLE 2 that the fluctuation in the thickness of the film of the applied magnetic liquid, which was caused by the vibration of the web, could be greatly reduced by the web vibration absorber provided in accordance with the present invention.

Figure 5:
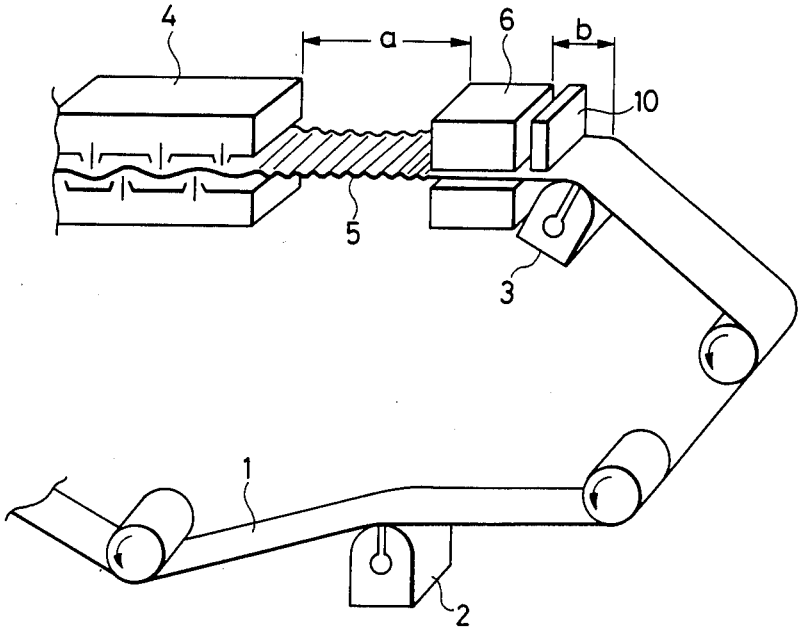
FIG. 5 shows a perspective view of the second embodiment of the present invention, in which a liquid application method provided in accordance with the present invention is used for a double-side liquid application device to manufacture a magnetic recording material.

FIG. 5 shows a perspective view of the second embodiment of the present invention, in which a web vibration absorber provided in accordance with the present invention is used for a double-sided liquid application device to manufacture a magnetic recording material. The same reference numerals in FIGS. 1 and 5 denote the same portions. The difference between the first and the second embodiments is that a solid blade (doctor blade) 10 is provided in contact with the surface of a web between the web vibration absorber and an applied liquid feeder in the second embodiment. Since the doctor blade 10 is provided between the web vibration absorber 6 and the applied liquid feeder 3 and is placed in contact with an applied liquid on the web 1, the portion of the doctor blade 10, which is placed contact with the applied liquid, is rounded when the blade is manufuctured. The form of the solid doctor blade 10 is made dimensionally appropriate to the speed of the movement of the web, its tension, the thickness of the film of the liquid applied to the web, the conditions or lapping, the physical properties of the liquid and so forth. It is preferable that the solid doctor blade 10 is made of a very hard alloy so as to be smooth.

In the second embodiment, the web 1 comes into contact with the solid blade 10 after the vibration of the web is very much reduced by the web vibration absorber. For that reason, the solid blade 10 pushes the web in without scraping the applied liquid off the web, to prevent the web from being wrinkled. The flatness of the web is thus secured.

An example of practical operation of the second embodiment is described from now on. The magnetic liquid having the composition shown in TABLE 1 was applied to both the sides of the web 1 as shown in FIG. 5, to manufacture the magnetic recording material. The examples of practical operation of the first and the second embodiments were the same except that in the second embodiment the solid blade was placed between the most upstream a gas ejection chamber and a second applied liquid feeder in the second embodiment. Since the web vibration absorber and the solid blade were provided, the vibration of the web was completely eliminated so that the web was not wrinkled in its longitudinal direction.

As described above, a web vibration absorber is provided in accordance with the present invention so as to eliminate the vibration of a web caused by a unit which buoys up the web by a gas. In the web vibration absorber, gas ejection chambers containing distributors are provided to face each other across the web to form thin films of a gas between the surface of the web and the gas ejection surfaces of the chambers. As a result, the vibration of the web, which conventionally cannot be eliminated, is in fact eliminated to prevent the thickness of the film of an applied liquid from fluctuating due to the vibration, to enable the use of a uniform double-side application device.

What is claimed is:

1. A liquid application method, comprising the steps of:

running a web;

applying a first liquid to a first side of said running web at a first position;

applying a second liquid to a second side of said running web at a second position;

drying said first and second liquids by blowing air on said first and second sides of said running web at a third position downstream of said running web from said first and second positions; and damping vibrations caused by said drying step by uniformly blowing air to said first and second sides of said running web at a position between said third position and the one of said first and second positions nearest said third position, wherein said damping step includes blowing air from one or more gas ejection surfaces disposed facing both of said sides of said running web, wherein said one or more gas ejection surfaces more closely approach said sides of said running web at positions more distant from said third position.

* * * * *